US005499958A

United States Patent [19]

Hess

[11] Patent Number: 5,499,958

[45] Date of Patent: Mar. 19, 1996

[54] PORTABLE AND REVERSIBLE LEG EXERCISING APPARATUS

[76] Inventor: Daniel F. Hess, 3148 Hyde Park, Lexington, Ky. 40503

[21] Appl. No.: 421,595

[22] Filed: Apr. 12, 1995

[51] Int. Cl.[6] ..... A63B 22/00

[52] U.S. Cl. ..... 482/79; 482/123; 482/124; 482/129; 482/70

[58] Field of Search ..... 482/79, 121, 122, 482/123, 124, 129, 130, 60, 70

[56] References Cited

U.S. PATENT DOCUMENTS

| | | | |
|---|---|---|---|
| 4,512,571 | 4/1985 | Hermelin | 482/70 |
| 4,733,858 | 3/1988 | Lan | 482/70 |
| 5,131,895 | 7/1992 | Rogers, Jr. | 482/70 |
| 5,224,909 | 7/1993 | Hamilton | 482/70 |
| 5,279,530 | 1/1994 | Hess | 482/79 |
| 5,295,935 | 3/1994 | Wang | 482/123 |
| 5,429,567 | 7/1995 | Gerschefske et al. | 482/70 |

*Primary Examiner*—Lynne A. Reichard
*Attorney, Agent, or Firm*—King and Schickli

[57] ABSTRACT

A reversible, portable leg exercising apparatus includes an inclined guideway supported on a frame. The guideway has upper and lower ends. A pedal is mounted for relative sliding movement along the guideway. A first reversing roller is provided at the upper end of the guideway and a second reversing roller is provided at the lower end. An elastic cord provides resistance to movement of the pedal. The elastic cord is selectively connectable in one of two positions. In a seated exercise position a first end of the cord is held by the pedal, an intermediate portion extends over the first reversing roller and a second end of the cord is held by the second reversing roller. In a reclined exercise position the first end of the cord is held by the first reversing roller, the intermediate portion of the cord extends over the second reversing roller and the second end of the cord is held by the pedal.

21 Claims, 2 Drawing Sheets

PORTABLE AND REVERSIBLE LEG EXERCISING APPARATUS

TECHNICAL FIELD

The present invention relates generally to leg exercising equipment and, more particularly, to a reversible, portable leg exercising apparatus providing effective exercise and rehabilitation for lower extremity and lower back problems from either a seated or recumbent position.

BACKGROUND OF THE INVENTION

It is widely recognized that regular physical exercise of the human body is a beneficial and integral part of developing and maintaining a healthy lifestyle. Exercise is useful for weight control, developing muscle tone and strength training. In addition, regular exercise has been shown to be an effective way of maintaining and improving an individual's cardiovascular health. Further, regular physical exercise has proven to be an important means of combating and reducing excess stress and stress-related physical ailments such as hypertension and fatigue. Additionally, repetitive exercise is commonly prescribed to patients suffering various injuries where it performs an important role in rehabilitation.

Depending on specific patient needs and injuries, as well as the type of tissue targeted, physical therapists have at their disposal many exercise options. For example, in order to develop or rehabilitate muscle tissue, an exercise regimen combining relatively heavy resistance with fewer repetitions, such as weight training, is often advantageous. In contrast, some tissues including ligaments, cartilage and tendons are frequently rehabilitated more effectively with targeted exercises that employ lower resistance with a comparatively greater number of repetitions.

In order to supply injured tissue with the oxygen that research has shown to be necessary to properly develop, strengthen and rehabilitate injured tissue, repetitive aerobic exercise is often prescribed. Since connective tissues such as ligaments, cartilage, and tendons require a greater amount of oxygen during rehabilitative exercise than muscle tissue, and because injuries to the lumbar spine often involve these connective tissues, many low back injuries are effectively treated by a rehabilitative program including a low resistance, high repetition exercise regimen.

Over the last several years, numerous aerobic exercise options have become available that target the lower body and advantageously emphasize highly repetitive movements coupled with low resistance. Examples include stair climbing machines, treadmills, stationary bicycles, and even devices that simulate cross country skiing. Nonetheless, although these aforementioned exercise devices are beneficial to those individuals desiring a more general aerobic workout, they are not always a feasible option to those suffering acute lower back pain.

Specifically, most of the exercise equipment mentioned above and in wide use today necessarily puts at least some measure of stress or strain on the lower back. While such a relatively low level of associated back strain is not a significant burden to the individual exercising for general aerobic conditioning, such additional strain is potentially painful or even counterproductive to those individuals exercising for rehabilitative purposes. Specifically, those persons with acute lower back pain require exercise that simultaneously provides ample aerobic benefits while minimizing the stress and strain placed on the lower back. As can readily be understood, exercise equipment such as stair climbers or treadmills do not adequately immobilize the lower back, and can indeed exacerbate existing lower back conditions if used improperly.

As an alternative, health clubs and fitness centers often have exercise machines specifically designed to isolate various muscle groups and body parts. For example, many clubs include leg press machines that enable the user to select an appropriate resistance according to specific needs. Users of such machines generally extend their legs in a pressing action causing a weighted platform of a chosen resistance to move. Such machines effectively isolate the lower extremities while minimizing lower back strain. In order to minimize strain during exercise, these machines have been constructed in a variety of designs that enable the user to operate the weight platform from a seated, recumbent, or even horizontal position. Although these machines have the advantage of being adaptable for strength or aerobic training by providing a wide range of resistances, their primary focus and use has been strength training. Specifically, such machines are generally configured in such a way so as to target musculature rather than connective tissues.

Another key disadvantage of using fitness center equipment for rehabilitation exercises is their relative inconvenience and inaccessibility. Specifically, many physical therapy patients may not be able to drive or might otherwise be inconveniently situated from a fitness center. Additionally, membership fees at many clubs may be economically prohibitive to many patients already facing additional medical care expenses. Although the equipment found in health clubs is generally available for home purchase, excessive cost and bulkiness of such equipment make home use of most "health club" equipment an unrealistic option.

An additional disadvantage found in the leg exercising equipment of the prior art is that most of the prior art machines require the exercise and simultaneous use of both legs in order for the apparatus to function properly. For example, cycling machines, both conventional and those designed for use in bed, require alternating movement of both legs. It can be appreciated, however, that many patients have disabilities that are best and most effectively rehabilitated by exercise of one leg at a time.

Many of the above described shortcomings are addressed in the leg exercise machine disclosed in the U.S. Pat. No. 5,279,530 to Hess, the inventor of the present invention. Specifically, the '530 patent discloses a portable leg exercising device especially adapted for lower back and lower extremity rehabilitation. This device advantageously emphasizes and targets the lower back by means of movement of pedals up a gradual incline against a resistance generated by one or more elastic cord(s). This device is, advantageously, lightweight and portable, but its use is unfortunately limited to individuals capable of exercising in a horizontal position. As should be appreciated, such a device, while overcoming several of the key disadvantages in the prior art, lacks a measure of versatility. For example, patients unable to comfortably and easily exercise in and rise from a reclined or horizontal position are not able to comfortably and effectively use this device.

Accordingly, there is a need for an improved lightweight, relatively inexpensive leg exercising apparatus that is portable and effective for treatment of lower back and lower extremity disabilities. Such a device should be capable of use for in-home physical therapy. Such a device should be capable of being used in a reclined or horizontal position by those patients confined to bed or who prefer to exercise on the floor. In addition, such a device should be versatile and readily adaptable for use by patients in a seated position so as to provide a means for meeting the general and varying needs of the patient population while also comfortably and effectively exercising a greater number of patients than did the prior art.

SUMMARY OF THE INVENTION

Accordingly, it is a primary object of the present invention to provide a portable leg exercising apparatus especially useful for treatment of lower extremity and back disabilities.

Another object of the present invention is to provide a portable leg exercising apparatus of simple, straightforward design that may be inexpensively constructed from low-cost materials yet still provide exceptional versatility and performance over a long service life.

Still another object of the present invention is to provide a lightweight portable leg exerciser capable of quick and convenient adaptation for use in either a seated or recumbent position.

Another object of the present invention is to provide a portable leg exerciser capable of exercising each leg individually or both legs simultaneously in order to make possible a variety of exercise options.

Yet another object of the present invention is to provide a portable leg exercising apparatus having ideal inclination, and independent elastic resistance and range of movement for each leg to provide the physical therapist and the patient with maximum versatility for establishing the ideal and most advantageous exercise program customized to the specific needs of the patient. In this way, full rehabilitation of an injury may be accomplished in the shortest possible time.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a reversible, portable leg exercising apparatus is provided. The apparatus is advantageously capable of use in either a reclined or a seated position. The device is further designed to provide the most efficient and comfortable lower extremity and back rehabilitation of the user.

The leg exercising apparatus includes an inclined guideway having an upper end and a lower end. A pedal is mounted on this inclined guideway in such a way as to facilitate relative sliding movement along the inclined guideway when pressure is applied. In order to provide a measure of resistance, each pedal has attached to it elastic resistance means to oppose the force generated by the user pushing on the pedal.

As should be appreciated, the pedal is designed and disposed in such a way so as to facilitate the engagement by the feet of the user from either a seated or a horizontal position. In order to accomplish this reversibility, the apparatus is provided with a first reversing roller mounted adjacent to the upper or higher end of the inclined guideway. Similarly, the apparatus includes a second reversing roller mounted adjacent to the lower end of the inclined guideway. Also, to enable interchangeability between seated and reclined exercise configurations, the elastic resistance means is provided with first and second selectively connectable ends.

Specifically, to operate the device from a seated exercise position, the first end of the elastic means is selectively connected with the pedal and the second end of the elastic means is connected with and held by the second reversing roller on the lower end of the inclined guideway. Similarly, to operate the device from a horizontal or reclined exercise position, the first end of the elastic means is selectively connected with the first reversing roller at the upper end of the inclined guideway and the second end of the elastic means is selectively connected to the pedal. Preferably, to enable efficient sliding movement of the pedal during exercise, a middle portion of the elastic means extends over the first reversing roller when the leg exercise apparatus is being used in the seated position. Similarly, when the apparatus is being used in the reclined exercise position, the middle portion of the elastic means extends over the second reversing roller on the lower end of the inclined guideway.

In the preferred embodiment, the inclined guideway comprises a pair of parallel spaced tubes connected together at their ends by means of a first cross member adjacent the first roller and a second cross member adjacent the second roller. The inclined guideway is also supported on a frame. The support frame includes a planar base portion and a pair of support posts that connect the inclined guideway to the base portion of the support frame.

The lower end of the inclined guideway is preferably connected to the support frame at a vertex position adjacent the location of the user when exercising in a reclined or horizontal position. In the preferred embodiment, this vertex defines an angle between 10°–45°. The upper end of the inclined guideway is similarly connected to the support posts of the frame portion at a position adjacent to the location of the user when exercising in a seated position. Accordingly, it can be visualized that the overall configuration of the leg exercising device is substantially V-shaped.

The support frame and inclined guideway are preferably comprised of lightweight, plastic tubular material although wood, aluminum and other appropriate construction materials may be utilized. This structural composition of the exercise apparatus thus facilitates convenient portability. This light weight construction is also of critical importance as the physical state of the user rehabilitating a lower back injury limits the user's motion and will only allow the user to comfortably manipulate lightweight devices. Accordingly, the utilization of lightweight materials throughout the construction of the present apparatus is imperative if an effective, user-friendly, portable apparatus is to be provided.

According to another important aspect of this invention, the leg exercise device is readily capable of quick adjustment for use in either a seated or reclined position. As will become apparent, in order to facilitate the quick adaptability of the exercise device, the elastic means, in the form of an elastic cord, is knotted at both a first and second end. To prepare the exercise device for use in the seated exercise position, the first knotted end of the elastic cord is selectively received in a notch in the base on the pedal. The notch is preferably disposed in the base on the side of the pedal opposite to that engaged with a foot during seated exercise. The notch is of such proportions so as to allow the insertion of the elastic cord therein. The first knotted end of the elastic cord is, however, wider than the notch opening and thus is prevented from sliding through the notch, thereby positively insuring connection. The elastic cord is threaded downwardly between the first cross member and over the first reversing roller. Finally, the elastic is stretched along the length of the inclined guideway and the second knotted end is pinched and captured between the second reversing roller and second cross member.

When configured in this manner, the exercise device is readily usable to conduct rehabilitative exercises from a seated position. Specifically, the unit may be placed on the floor with the high end near the front of a chair or couch, thereby enabling the user to exercise from a seated position with minimal back strain. A strap with buckling-closure may be attached to the upper end of the device to secure it to the chair.

In order to configure the leg exercise machine for use in the reclined or horizontal position, the second end of the elastic cord is engaged in a "keyhole" shaped aperture located on the underside of the pedal. Again, the knot on the second end engages the pedal and will not pull through the keyhole aperture, thereby providing a secure connection. The elastic cord is then threaded downwardly between the second cross member and the second reversing roller. Finally, the elastic cord is stretched along the length of the inclined guideway and the first knotted end is pinched and captured between the first reversing roller and the first cross member.

When configured in this manner, the leg exercising device is now usable for exercise in a horizontal or reclined position. Specifically, the unit may be placed on the floor, treatment table or be used in bed, thus enabling a user to exercise lying down with minimal associated back strain.

In the most preferred embodiment, the leg exercise device incorporates a pair of guideways with cooperating pedals, reversing rollers and elastic cords as just described. As should be appreciated, this embodiment allows the user to exercise a single leg independently, or both legs together, depending on exercise or rehabilitation needs. Additionally, the preferred embodiment includes at least one elastic cord on each pedal. Additional cords could be used, however, for added resistance to each leg as needed.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention.

In FIG. 1, the apparatus is configured to allow operation from the seated position along guideway 12' and from the reclined position along guideway 12. This is done only for purposes of illustration of both configurations. In actual use, both guideways 12, 12' generally would be configured for operation from the same position; either seated or reclined.

DETAILED DESCRIPTION OF THE INVENTION

Figure 1:
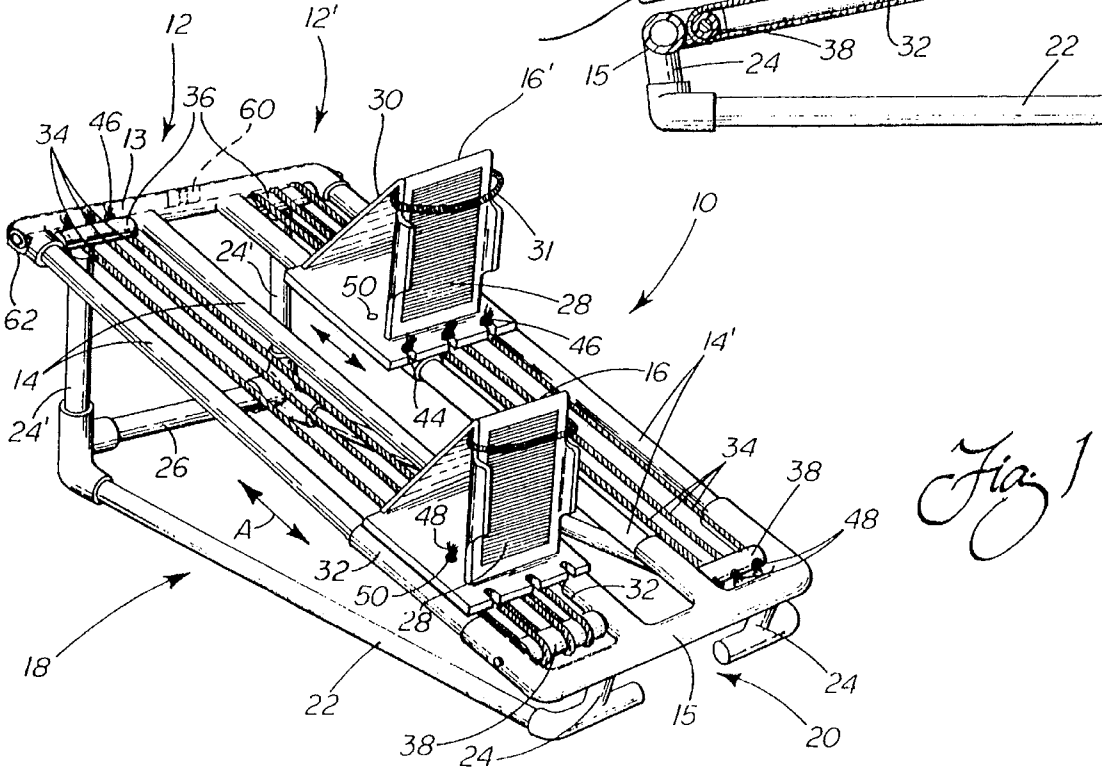
FIG. 1 is a perspective view of the leg exercising apparatus of the preferred embodiment of the present invention.

As shown in FIG. 1, the apparatus 10 is particularly useful for those patients who require rehabilitation of the lower back or lower extremities, such as the hips, knees or the ankles. Notably, and as will become apparent, the apparatus 10 is readily and quickly adaptable for use in either a reclined, position or a seated position. The use of the leg exercising apparatus 10 achieves the desired rehabilitative results while allowing a particular patient or attending physical therapist to select an appropriate configuration for the apparatus in order to achieve the most beneficial results.

In the preferred embodiment, an inclined guideway, generally designated by reference numeral 12, includes two sets of two parallel spaced tubes 14 connected together at their first ends by a first cross member 13 and at their second, opposite ends by a second cross member 15. The tubes 14 support a foot pedal 16 that is engaged by a foot of the user during exercise(see FIGS. 2 and 3). Each foot pedal 16 is mounted for independent sliding travel along the tubes 14 of the inclined guideway 12 (see action arrows A in FIG. 1). As should be appreciated, the apparatus 10 preferably includes a second inclined guideway 12' including a pair of tubes 14' connected together by cross members 13, 15 for guiding a second pedal 16'. Thus, one pedal 16, 16' is provided for each foot so that each leg of the user is capable of being flexed and extended either independently of each other or together depending on the direction of the therapist to achieve the desired rehabilitative result.

In the preferred embodiment, and as best shown in FIG. 1, the inclined guideways 12, 12' are supported on frame 18 that, like the inclined guideways, may be comprised of lightweight, tubular plastic material for portability and ease of handling. Advantageously, the support frame 18 and the inclined guideways 12, 12' are connected at a vertex 20 to comprise a substantially V-shaped configuration when set up for operation (see FIG. 1). The base 22 of the support frame 18 is disposed in a single plane to form one side of the "V". The support frame 18 also preferably includes two pairs of support posts 24, 24 and 24', 24'. This configuration of relatively short posts 24, 24 and long posts 24', 24' defines the preferred slope or incline of the guideways 12, 12' thereby facilitating an advantageous biomechanical result of substantial lower extremity flexing and aerobic exercising without undesirable compression of the spine. As can be seen in FIG. 1, the relative dimensions of the support frame 18 create a vertex angle 20 that in the preferred embodiment is between 10°–45° for maximum rehabilitative results and patient comfort. Cross member 26 connects the long posts 24', 24' together to further enhance the rigidity of the construction.

Figure 3:
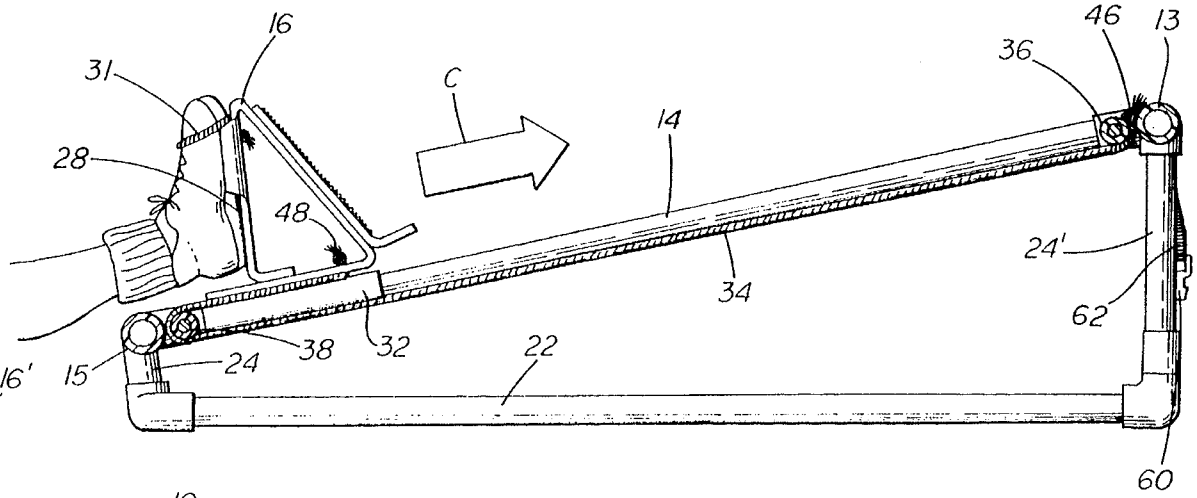
FIG. 3 is a cross-sectional view of the leg exercising machine, taken along lines 3—3 of FIG. 1 showing a user exercising with the machine adapted for exercise in a horizontal or reclined position.
Figure 2:
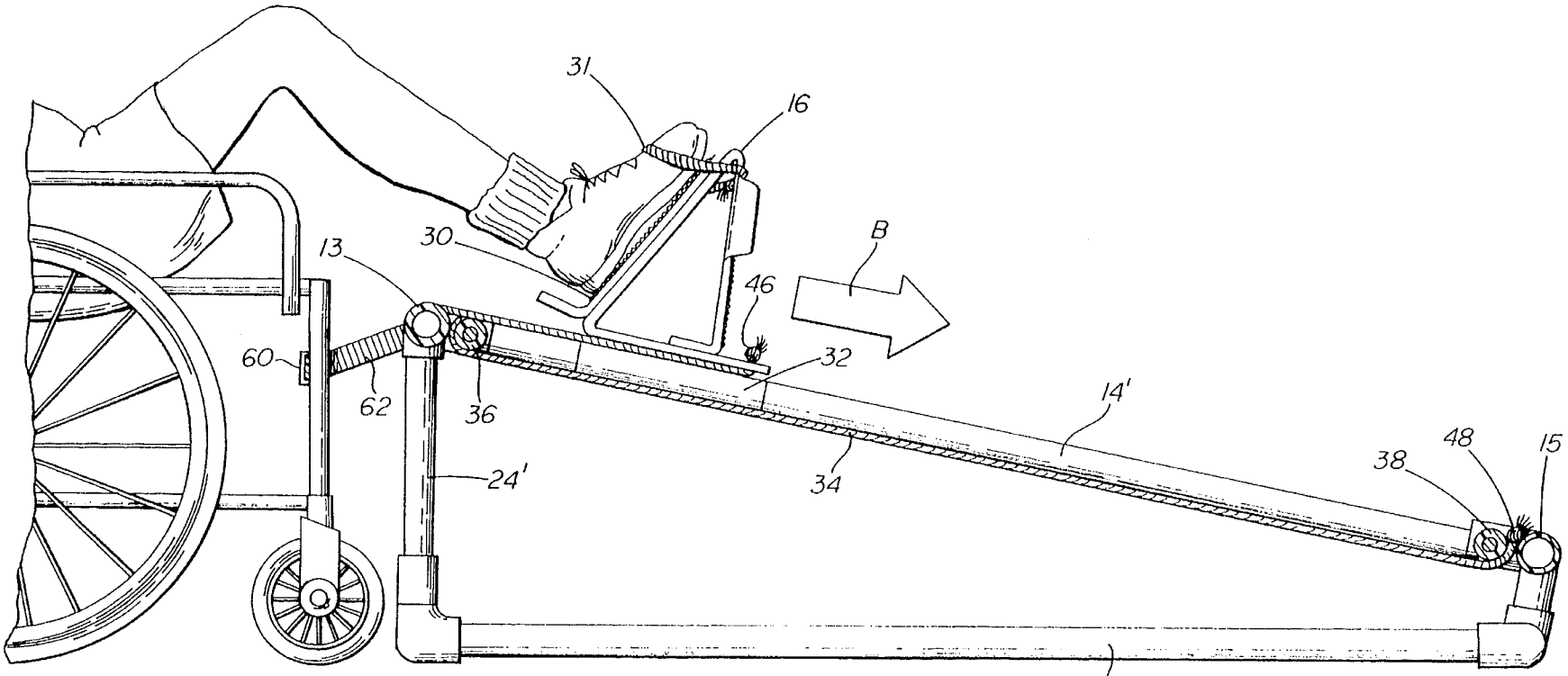
FIG. 2 is a cross-sectional view of the leg exercising machine, taken along lines 2—2 of FIG. 1 showing a user exercising with the machine adapted for exercise in a seated position.

As best shown in FIGS. 2 and 3, each foot pedal 16, 16' is disposed in a substantially upright position. More specifically, each pedal 16, 16' has a substantially triangular shape. Thus, each pedal 16, 16' is provided with one face 28, closest to the vertex 20 of the apparatus 10, that extends at a very slightly obtuse angle relative to the longitudinal axis of the inclined guideway 12. This face 28 is engaged by the user using the apparatus 10 in the reclined or horizontal position. The pedal 16 is further provided with another face 30, facing toward the upper end of the apparatus 10 (e.g. directed away form the vertex 20), that forms an obtuse angle relative to the longitudinal axis of the guideways 12, 12'. This face 30 is engaged by the user using the apparatus 10 in the seated position. In order to provide for the maximum frictional engagement of the pedal 16, 16' with the foot of the user, rubberized surfaces may be utilized on the pedal for contact therewith (see FIG. 1). Elastic straps 31 may also be provided.

Each foot pedal 16, 16' includes a pair of guide sleeves 32. The guide sleeves 32 of the first foot pedal 16 are concentrically received for relative sliding movement on the guideway tubes 14, 14. The guide sleeves 32 of the second foot pedal 16' are concentrically received for relative sliding movement on the guideway tubes 14', 14' As the user presses on the pedals 16, 16', the pedals slide over the guideways 12, 12' guided by the guide sleeves 32 over the tubes 14, 14 and 14', 14' respectively (note action arrow A in FIG. 1).

In order to advantageously supply the desired exercise resistance, a plurality of elastic cords 34 are attached to the foot pedals 16, 16'. The elastic resistance provided by the cords 34 allow for a high number of repetitions at a relatively fast rate of speed. The farther a user extends his legs and, therefore, the pedals 16, 16' against the resistances of the cords, the greater the force the user must apply for further extension.

According to an important aspect of this invention, the apparatus 10 is capable of quick adjustment for use in either a seated or a reclined position. As best shown in FIGS. 1 and 2, in order to facilitate the advantageous reversibility of the apparatus 10, first and second reversible rollers 36, 38 are respectively mounted in a transverse fashion on upper and lower portions of each of the inclined guideways 12, 12'. As will later become apparent, reversibility is further facilitated by the provision on the inclined guideway 12, 12' of the first and second cross members 13, 15 extending respectively transversely across the upper and lower portions of the guideways 12, 12' adjacent the reversible rollers 36, 38.

To enable the apparatus 10 to be used for exercise in the seated position, the pedals 16, 16' is provided with one or more notches 44 on the bottom of the pedals. Specifically, the notches 44 are advantageously disposed along the edge of the bottom part of the pedal 16, 16' that is closest to the vertex 20 of the apparatus 10. Additionally, the elastic cords 34 are preferably provided with first and second knotted ends 46, 48. To install the elastic cords 34 for use of the apparatus 10 in the seated position, the first knotted ends 46 are selectively received in the notches 44 of the pedals 16, 16'. Specifically, each notch 44 is sized to receive the cord 34. The knotted end 46 is, however, of sufficient size to engage the pedal 16, 16' and not pull through the notch, thereby securing the elastic cord connection. The elastic cords 34 are next threaded downwardly so that an intermediate portion passes between the first cross member 13 and the first reversing roller 36. Finally, the elastic cords 34 are stretched along the length of the guideways 12, 12' and the second knotted ends 48 are pinched and captured between the second reversing roller 38 and second cross member 15.

Next, buckle 60 of the strap 62, which is connected at each end to the first cross member 13, is disconnected. The strap 62 is then extended around the front legs L of the chair in which the individual is sitting. The buckle 60 is then reconnected and the strap 62 is tightened. This serves to secure the apparatus 10 to the chair during exercising, thereby substantially preventing shifting of the apparatus and rearward tipping of the chair.

To enable the apparatus to be used for exercise in the reclined position, and as best shown in FIGS. 1 and 3, the base of the triangle that forms the pedals 16, 16' is provided with one or more keyhole shaped apertures 50. The keyhole shaped apertures 50 are disposed with the narrow portion or end to the lower end or vertex 20 of the apparatus 10. To install the elastic cords 34 for use of the apparatus 10 in the reclined position, the second knotted ends 48 are positioned in the keyhole shaped apertures 50 of the pedals 16, 16' and secured in place therein. Specifically, the second knotted ends 48 are threaded upwardly from the underside of the pedals 16, 16' so as to pass through the wider diameter end of the keyhole shaped apertures 50. Next, the elastic cords 34 are pulled into and received in engagement with the narrow portion of the keyhole shaped apertures 50. As the knotted ends 48 are too large to pull through the narrow end of the keyhole shaped apertures 50, the elastic cords 34 are secured in position.

The elastic cords 34 are then threaded downwardly so that an intermediate portion passes between the second cross member 15 and the second reversing rollers 38. Finally, the elastic cords 34 are stretched along the length of the inclined guideways 12, 12' where the first knotted ends 46 are pinched and captured between the first reversing rollers 36 and the first cross member 13. Notably, when the apparatus is configured for use in the reclined position, those individuals confined to bed or those who prefer or are directed for rehabilitation purposes to exercise in a recline or supine position may benefit.

As should be appreciated, the first and second rollers 36, 38 are capable of rotation to reduce the strain and aid the elastic cords 34 to extend and retract during exercising movement (see action arrows B and C in FIGS. 2 and 3, respectively). Preferably, each first and second roller 36, 38 includes a number of grooves designed to receive and guide the elastic cords 34 therein to assist in maintaining the proper spacing therebetween.

It should be noted that elastic cords 34 of varying lengths may be selectively used with the present invention. It can be appreciated that the resistance applied by shorter elastic cords 34 is greater due to the greater tension required to install the elastic cords on the leg exercising device. Accordingly, if it is desired to increase the resistance to induce greater effort by the user, elastic means of relatively shorter lengths may be used.

Advantageously, the present apparatus 10 may be used to exercise in either a supine or seated position. Thus, the apparatus 10 may be effectively utilized by patients who desire or require either or both modes of exercise. For example, when configured for exercise in a seated position (see FIG. 2), elderly individuals and those other patients whose mobility is somewhat restricted and are therefore only able to comfortably assume and exercise in a seated position, will benefit from the present apparatus 10. Specifically, the seated individual faces the higher end of the apparatus 10, places his or her feet on the appropriate surfaces 30 of the pedals 16, 16', and proceeds to extend and retract the legs (see action arrow B in FIG. 2).

Alternatively, the present invention may be configured for exercise in a supine or reclined position. Patients requiring or desiring rehabilitation in this position are also able to benefit from the present invention. In essence, by adjusting the configuration of the apparatus 10 and/or the tension on the pedals 16, 16' provided by the elastic cords 34, it is possible to customize an exercise program to the needs of the patient. Further, the reconfiguration of the apparatus from one mode of operation to the other (e.g. seating vs. supine) is a simple task that may be conveniently completed in a very short period of time. As the apparatus is lightweight and easily manipulated, no straining is involved.

In summary, numerous benefits result from the use of the reversible, portable leg exercising apparatus 10. Users of the present invention may exercise either leg independently or both legs at a given time. Further, each leg may be advantageously exercised utilizing varying tensions and resistance. Elastic cords 34 provide the ideal resistance opposing the force exerted by the user. This permits a high number of repetitions with comfortable resistance. Significantly, the apparatus may be quickly adapted for use in either a reclined or a seated position, thus making its benefits available for a wider range of patients. Further, the lightweight device is easily transported for exercise in different locations. Accordingly, the apparatus 10 is ideally suited for rehabilitative exercise for lower extremity and back problems while affording versatility and portability.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

Claims:

1. A reversible, portable leg exercising apparatus, comprising:

an inclined guideway having an upper end and a lower end;

a pedal mounted for relative sliding movement along said guideway;

a first reversing roller mounted adjacent said upper end of said guideway;

a second reversing roller mounted adjacent said lower end of said guideway; and an elastic means for providing resistance to movement of said pedal, said elastic means including first and second ends and being selectively connectable in a seated exercise position with said first end being held by said pedal and said second end being held by said second reversing roller and in a reclined exercise position with said first end being held by said first reversing roller and said second end being held by said pedal.

2. The exercising apparatus set forth in claim 1, wherein said elastic means includes an intermediate portion extending over said first reversing roller in the seated exercise position and extending over said second reversing roller in the reclined exercise position.

3. The exercising apparatus set forth in claim 2, wherein said inclined guideway comprises a pair of two spaced parallel tubes connected together by a first cross member adjacent said first roller at said upper end and by a second cross member adjacent said second roller at said lower end.

4. The exercising apparatus set forth in claim 3, wherein said inclined guideway is supported on a frame.

5. The exercising apparatus set forth in claim 4, wherein said elastic means is an elastic cord including a first knot at said first end and a second knot at said second end.

6. The exercising apparatus set forth in claim 5, wherein said second knot is pinched and captured between said second reversing roller and second cross member when in said seated exercising position and said first knot is pinched and captured between said first reversing roller and first cross member when in said reclined exercise position.

7. The exercising apparatus set forth in claim 6, wherein said pedal includes means for selectively receiving and holding said first and second knots of said elastic cord.

8. The exercising apparatus set forth in claim 7, wherein said receiving and holding means comprises a notch.

9. The exercising apparatus set forth in claim 7, wherein said receiving and holding means comprises a keyhole aperture having an enlarged opening for the passage of said knot in communication with a narrow channel for receiving said elastic cord but engaging said knot.

10. The exercising apparatus set forth in claim 9, including a second inclined guideway having an upper and lower end;

a second pedal mounted for relative sliding movement along said second guideway;

a third reversing roller mounted adjacent said upper end of said second guideway;

a fourth reversing roller mounted adjacent said lower end of said second guideway; and a second elastic means for providing resistance to movement of said second pedal, said second elastic means including third and fourth ends and being selectively connectable in a seated exercise position with said third end being held by said second pedal and said fourth end being held by said fourth reversing roller and in a reclined exercise position with said third end being held by said third reversing roller and said fourth end being held by said second pedal.

11. The exercising apparatus set forth in claim 10, wherein said second elastic means includes an intermediate portion extending over said third reversing roller in the seated exercise position and extending over said fourth reversing roller in the reclined exercise position.

12. The exercising apparatus set fourth in claim 11, wherein said second inclined guideway comprises a second pair of spaced, parallel tubes connected together by said first cross member adjacent said third roller and by said second cross member adjacent said fourth roller.

13. The exercising apparatus set forth in claim 12, wherein said second inclined guideway is also supported on said frame.

14. The exercising apparatus set forth in claim 13, wherein said second elastic means is an elastic cord including a third knot at said third end and a fourth knot at said fourth end.

15. The exercising apparatus set forth in claim 14, wherein said fourth knot is pinched and captured between said fourth reversing roller and second cross member when in said seated exercising position and said third knot is pinched and captured between said third reversing roller and first cross member when in said reclined exercise position.

16. The exercising apparatus set forth in claim 15, wherein said second pedal includes means for selectively receiving and holding said third and fourth knots of said second elastic cord.

17. The exercising apparatus set forth in claim 16, wherein said receiving and holding means comprises a notch.

18. The exercising apparatus set forth in claim 17, wherein said receiving and holding means comprises a keyhole aperture having an enlarged opening for the passage of said knot in communication with a narrow channel for receiving said elastic cord but engaging said knot.

19. The exercising apparatus set forth in claim 18, wherein at least one elastic cord is attached to each pedal.

20. The exercising apparatus set forth in claim 19, wherein said support frame is substantially V-shaped having a vertex defining an angle between 10°–45°.

21. The exercising apparatus set forth in claim 1, further including means attached to said inclined guideway for securing said apparatus to a chair when exercising in said seated exercise position.

* * * * *